United States Patent [19]

McGowan, III et al.

[11] Patent Number: 4,797,669

[45] Date of Patent: Jan. 10, 1989

[54] RECEIVER

[75] Inventors: David L. McGowan, III, Warminster; Arthur M. Olsen, Pennsburg; Steven M. Oxenberg, Richboro, all of Pa.

[73] Assignee: Honeywell Inc., Minneapolis, Minn.

[21] Appl. No.: 913,925

[22] Filed: Oct. 1, 1986

[51] Int. Cl.[4] ..... G08C 15/00

[52] U.S. Cl. ..... 340/870.40; 340/870.16; 340/870.39; 340/310 R

[58] Field of Search ..... 340/870.40, 870.39, 340/870.42, 316, 317, 310 R, 310 A, 870.16

[56] References Cited

U.S. PATENT DOCUMENTS

| | | | |
|---|---|---|---|
| 4,466,074 | 8/1984 | Jindrick et al. | 364/483 |
| 4,520,488 | 5/1985 | Houvig et al. | 340/870.39 |
| 4,623,871 | 11/1986 | Akano | 340/870.39 |

*Primary Examiner*—John W. Caldwell, Sr.
*Assistant Examiner*—Tyrone Queen
*Attorney, Agent, or Firm*—Mitchell J. Halista; Albin Medved

[57] ABSTRACT

A receiver for receiving a reception signal defining a measured value is connected to a two-wire transmission line used for transmitting a digital command signal from a communicator, a digital measured value signal from a transmitter, and a response signal responding to the command signal. The receiver includes a timer for discriminating that a nonsignalling state of the two-wire transmission line has continued for a predetermined period, and a CPU for validating a specific period of a reception signal received after the discrimination operation of the timer.

15 Claims, 8 Drawing Sheets

RECEIVER

BACKGROUND OF THE INVENTION

1. Field of the Invention

The present invention relates to a receiver suitable for receiving measured values transmitted through a two-wire transmission line.

2. Description of the Prior Art

In order to transmit outputs from a differential pressure transmitter, an electromagnetic flowmeter or the like representing measured values to a remote location according to conventional industrial measurement techniques, a unique signal having a current of 4–20 mA is used. An analog signal having a current selected from this range to represent a measured value is transmitted on a two-wire transmission line and is received by a receiver. Such differential pressure transmitters, electromagnetic flowmeters and the like are normally arranged in a distributed manner to monitor industrial process states in a wide physical area. Maintenance personnal must travel extensively to maintain and inspect the distributed measuring instruments so as to perform adjustments and check the operating conditions thereof. In order to eliminate such time-consuming maintenance or the like, existing equipment is utilized to achieve remote control operation of the measuring instruments, as described in U.S. Pat. No. 4,520,488.

As shown therein, a communicator is bridged to a two-wire transmission line to transmit a digital signal. At the time the digital signal is received by a transmitter, the transmitter stops transmitting an analog measured value signal and sends a response signal to the communicator. A similar mode of operation is achieved for digital signal communication between the communicator and the transmitter. The receiver converts the analog signal to a digital form and sends on the measured value in the form of a digital signal, thereby repeating digital signal transmission.

Since when the transmitter communicates with the communicator by means of the digital signal, the transmitter stops transmitting the analog signal, i.e., stops transmitting the measured value, if the measured value concurrently changes, the changed measured value cannot be immediately transmitted to the receiver. Therefore, the receiver cannot initiate an immediate control operation according to the changed measured value. This impairs the ability of equipment to be controlled by the receiver to follow changes in the measured values.

Further, the measured value to be transmitted from the transmitter to the receiver is sent in the form of digital signal, and the digital measured value is added to a response signal sent from the transmitter in response to the command signal from the communicator, whereby a composite signal is actually sent. However, if a digital signal excluding the measured value signal in an identical format is sent through a common transmission line, the receiver connected thereto receives all signals. In this case, the receiver receives digital signals in addition to the digital measured value signal in a mixed manner, and the control state of the receiver is disturbed which can produce an error in the control operation.

SUMMARY OF THE INVENTION

It is, therefore, a first object of the present invention to provide a receiver capable of receiving only a measured value without adding an address code or the like representing a destination to each signal.

It is a second object of the present invention to provide a receiver free from disturbance of the control state therein since signals other than the measured value are not accepted.

In order to achieve the above objects of the present invention, there is provided a receiver for receiving a reception signal defining a measured value, the receiver being connected to a transmission line used for transmitting a digital command signal from a communicator, a digital measured value signal from a transmitter, and a response signal responding to the command signal, comprising time defining means for discriminating that a nonsignalling state of the transmission line has continued for a predetermined period, and control means for validating a specific period of a signal received after the discrimination operation of the time defining means.

Thus, even if the response signal is sent together with the measured value, only the measured value is sent for the predetermined period after the start of transmission. At the same time, the nonsignalling state of the predetermined period is provided prior to this transmission so that the transmitting state of the transmitter is determined. In the receiver, since the reception is started after the nonsignalling state continues for a predetermined period of time, only the reception signal received for a predetermined period of time after the start of reception is validated, thereby properly receiving only the measured value.

DESCRIPTION OF THE PREFERRED EMBODIMENTS

Figure 1:
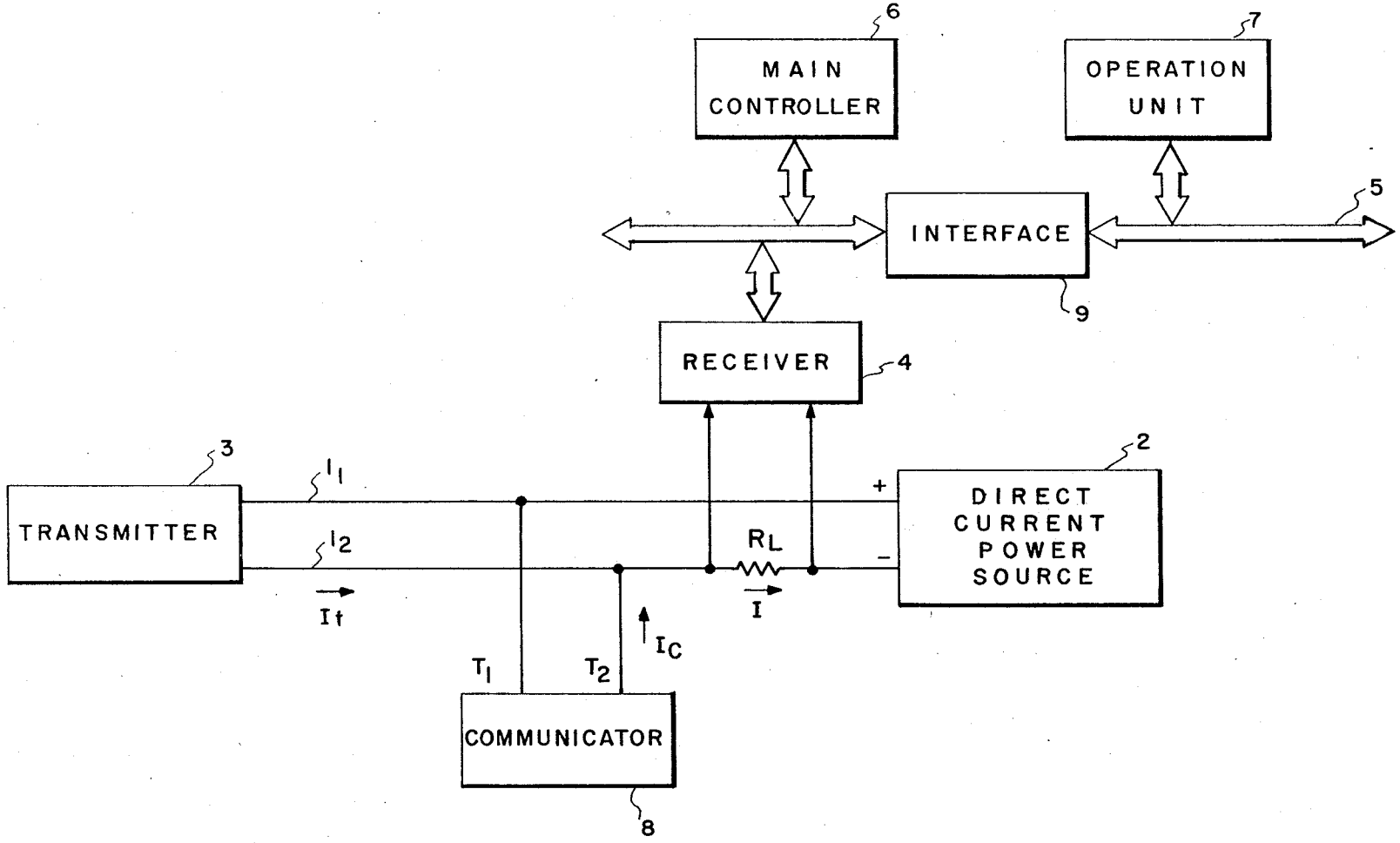
FIG. 1 is a block diagram shown an overall two-wire transmission system configuration.

FIG. 1 is a block diagram showing an overall two-wire transmission utilizing the present invention. A direct current (DC) power source (referred to as a PS hereinafter) 2 is connected one end of a two-wire transmission line (referred to as a transmission line) 1 consisting of signal lines $l_1$ and $l_2$ to supply a current thereto. A transmitter (referred to as a TX hereinafter) 3 such as a pressure difference transmitter and an electromagnetic flowmeter is connected to the other end of the transmission line. The TX 3 controls a current I in the transmission line 1 to generate signal pulses. The signal pulses are sent as a digital signal representing a measured value onto the transmission line 1.

A resistor RL as a voltage dropping element is inserted in series with the transmission line 1. A voltage across the resistor RL is supplied to a receiver (referred to as an RX hereinafter) 4 whereby the RX 4 receives the transmitted signal. An output signal from the RX 4 is sent to a main controller (referred to as an MC hereinafter) 6 such as a computer through a bus 5. Control operations by the MC 6 are performed on the basis of the measured value represented by the digital outpout signal supplied from the RX 4. Control data is sent to equipment (not shown) from the MC 6 through the bus 5, thereby controlling the equipment.

An operation unit (referred to as an OP hereinafter) 7, which can include a CRT display and a keyboard, is connected to a bus 5 through an interface (referred to as an I/F hereinafter) 9, for displaying a controlled state of the equipment and inputting a command to the MC 6 and the RX 4. A portable communicator (referred to as a CT hereinafter) 8 is bridged in the transmission line nearer to the TX 3 than the resistor RL. The CT 8 converts the current I into signal pulses and sends them as a digital command signal to the TX 3. The TX 3 receives the command signal and converts the current I into signal pulses as a response signal which is sent to the CT 8 in response to the command signal.

Figure 3:
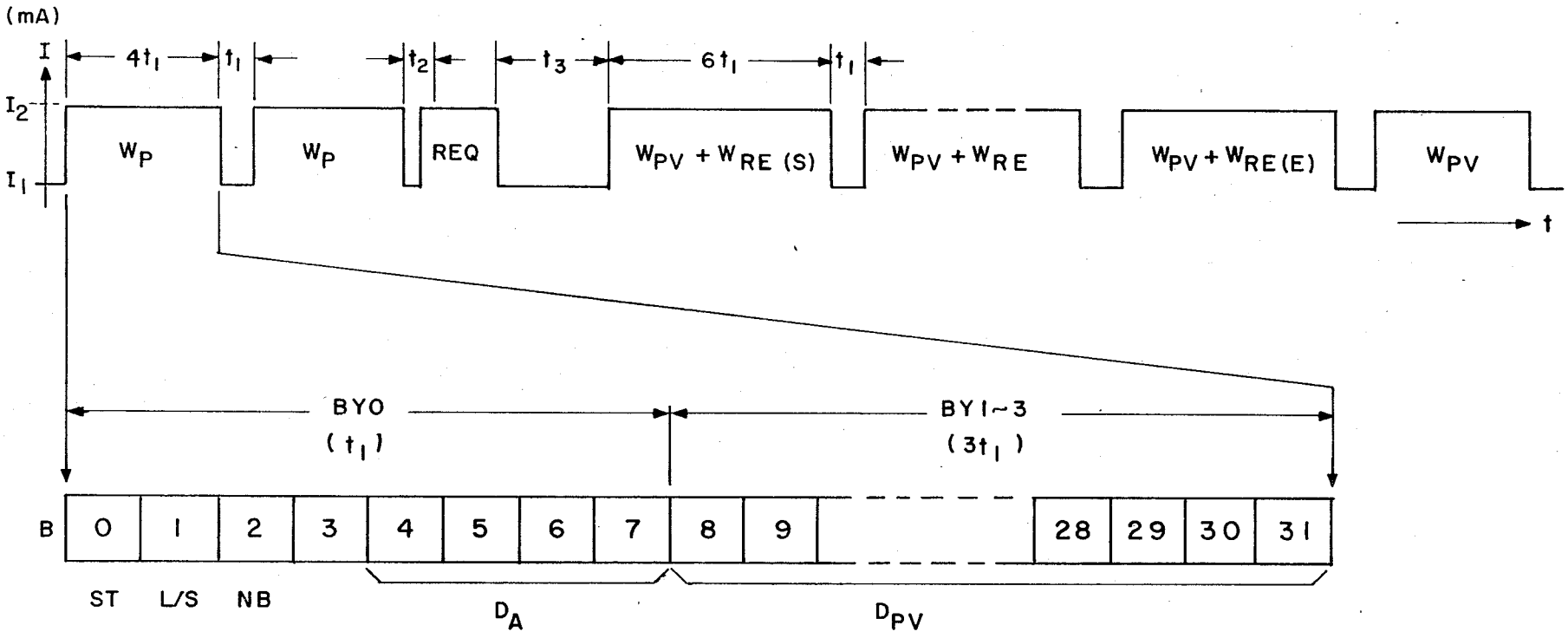
FIG. 3 is a timing chart for explaining changes in current for the two-wire transmission system current.

FIG. 3 shows a waveform of changes in current I supplied through the resistor RL as a function of time "t". In this case, the digital signal is a pulse code, the current of which changes in the range of $I_1$ to $I_2$, e.g., 4–20 mA. A measured process value word WPV determined by the measured value from the TX 3 comprises 4-byte data consisting of bytes BY0 to BY3 (each byte consists of eight bits). If the length of time for each of the bytes BY0 to BY3 is "t1", e.g., 50 msec, the length of time of the measured value word WPV is "4t1", and the disable period following the word WPV is "t1". The measured value word WPV is repeatedly transmitted by changes in current It supplied across the lines of the TX 3, thereby always transmitting the newest measured value to the RX 4.

In this state, a command signal REQ as a pulse code is transmitted within a reception wait period "t2" shorter than the disable period "t1" by changing of a current Ic supplied from the CT 8 to line terminals T1 and T2 at the end of transmission of the measured value word WPV. The change in current causes a change in voltage across the resistor RL. The change in voltage across the resistor RL is sent as a change in voltage between the signal lines $l_1$ and $l_2$ to the TX 3. Therefore, the command signal REQ is received by the TX 3.

The TX 3 stops transmitting the measured value word WPV in response to the command signal REQ sends back both a 4-byte measured value word WPV and a 2-byte response word WRE corresponding to the command signal REQ by means of the current It when a predetermined period "t3" has elapsed. In this case, transmission for a period "6t1" from a start word WRE(S) to an end word WRE(E) is repeated through the disable period t1. The measured value word WPV is then transmitted again. Thus, the voltage between the lines $l_1$ and $l_2$ is changed, and this change is received by the CT 8.

A start bit B0 of bits B0 to B31 in the start byte BY0 in the measured word WPV represents status ST indicating whether the TX 3 is normally operated. The bit B1 represents a proportional relation L, i.e., a linear relationship between the measured value and the control value according to sensor characteristics, or a squared proportional relationship S, i.e., a relationship representing that the measured value is a square of the control value. The bit B2 represents the number NB of continuous bytes, i.e., that the number of continuous bytes if four or six. The bits B4 to B7 represent the type DA of the measured value transmitted by the bytes BY1 and BY3. Bytes BY1 to BY3 represent a measured value DPV. When the measured value is sent together with the response signal in the form of WPV+WRE, the response word WRE is transmitted continuously after the measured value word WPV. The number of bytes of each word and the number of bits of each byte can be determined according to the control states. The periods t1 to t3 are also properly determined according to the bit rate.

Figure 4:
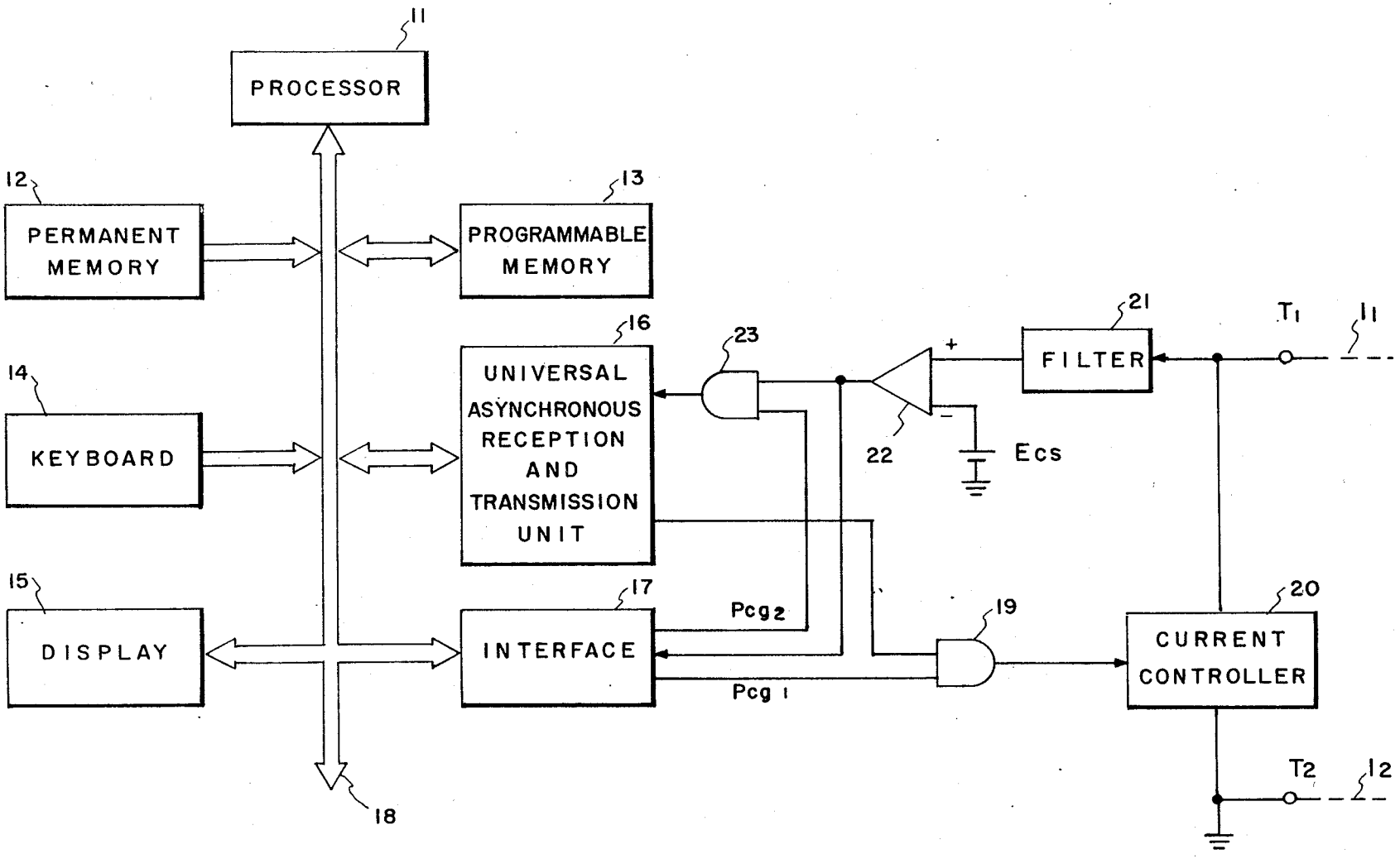
FIG. 4 is a block diagram of a communicator used in the system shown in FIG. 1.

FIG. 4 is a block diagram of the CT 8. A processor (referred to as a CPU hereinafter) 11 such as a microprocessor is used in the CT 8. The CPU 11 is connected to a permanent memory (referred to as a ROM hereinafter) 12 and to a data memory (referred to as a RAM hereinafter) 13, a keyboard (referred to as a KB hereinafter) 14, a display (referred to as DP) 15 such as a numerical display, a universal asynchronous reception and transmission unit (referred to as an I/F hereinafter) 17. The above components are connected to each other through a bus 18. A program stored in the ROM 12 is used under the control of the CPU 11, and a control operation is performed while predetermined data is accessed to the RAM 13.

If desired input data is supplied at the KB 14, the CPU 11 controls the UART 16 and sends a gate pulse Pcg1 as an "H" (high level) signal to the I/F 17. The AND gate 19 is turned on to gate the "H" pulse from the UART 16 to a current controller (referred to as a CC hereinafter) 20. Therefore, a current Ic is supplied from the terminal T1 to the terminal T2.

A voltage between the lines $l_1$ and $l_2$ is supplied to a filter (referred to as an FL hereinafter) 21 for filtering only a frequency component of the digital signal. The filtered signal is then supplied to one input terminal of a comparator (referred to as a CP hereinafter) 22. The filtered signal is compared by the CP 22 with a reference voltage Ecs supplied to the other input terminal thereof. The CP 22 extracts a level exceeding the reference voltage Ecs to be used as an output from the CP 22.

For this reason, after the transmission of the command signal REQ, a gate pulse Pcg2 is sent out as an "H" pulse from the I/F 17 when the output representing the start bit B0 of the measured value word WPV is supplied through the I/F 17. The AND gate 23 is turned on, and then the output representing the bit B1 and the subsequent bits is sent to the UART 16. The resulting data is displayed on the DP 15 in response to this output. Even if the TX 3 repeatedly transmits the measured value word WPV, the reception is normally performed. Therefore, the measured value can be displayed on the DP 15.

Figure 5:
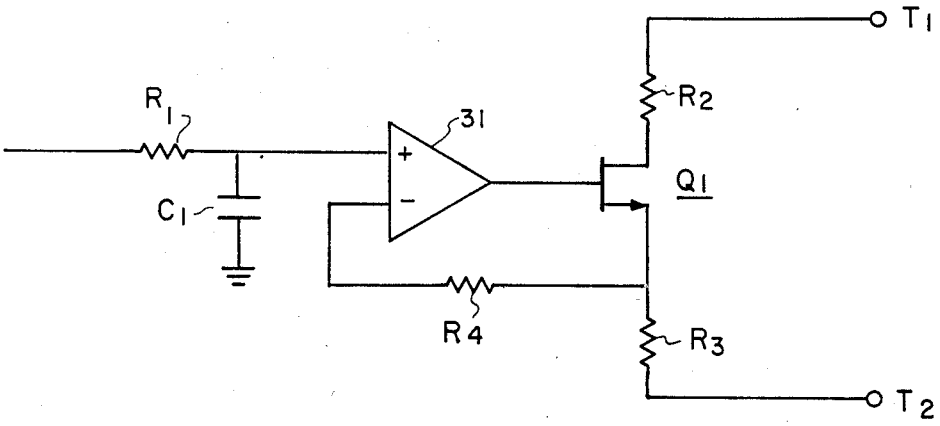
FIG. 5 is a circuit diagram of a current controller used in the system shown in FIG. 2.

FIG. 5 is a circuit diagram of the CC 20. A transmission pulse from the AND gate 19 through a noise reduction low-pass filter consisting of a resistor R1 and a capacitor C1 is amplified by a differential amplifier (referred to as an A hereinafter) 31 to turn on a transistor Q1 such as a field effect transistor. The current Ic is supplied through resistors R2 and R3. A voltage across the resistor R3 is negatively fed back to the A 31 through a resistor R4 so that the current Ic is maintained at a predetermined value.

Figure 6:
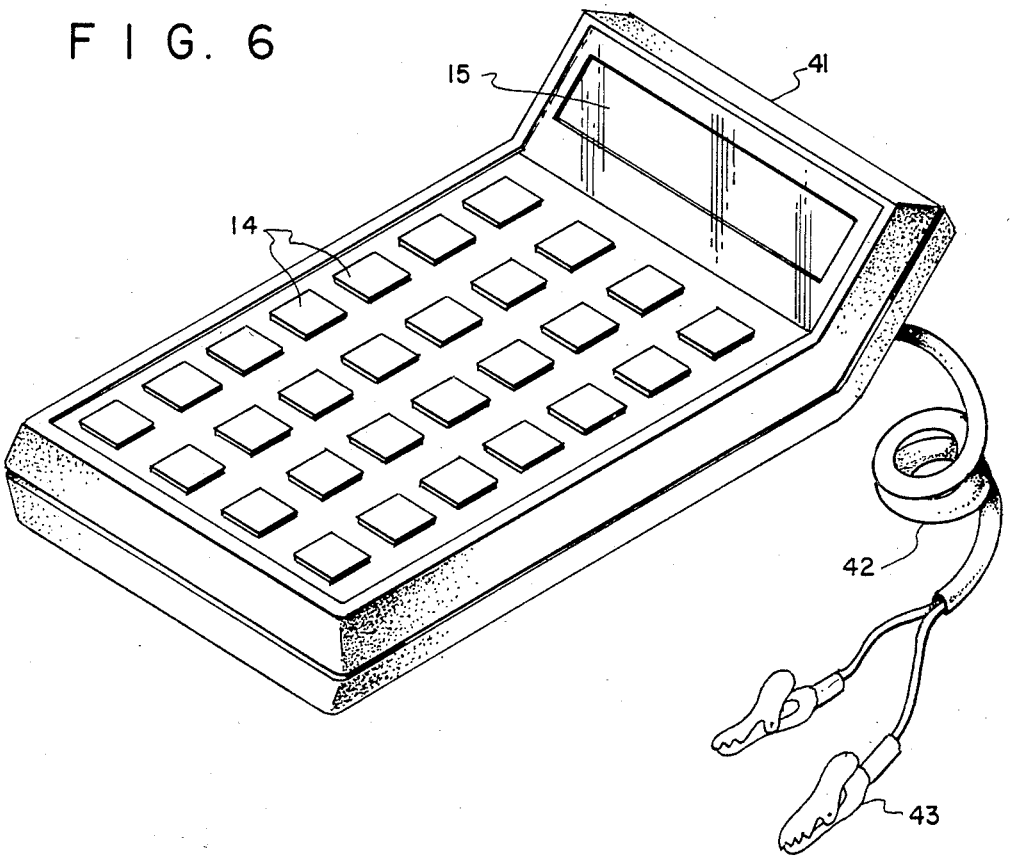
FIG. 6 is a perspective pictorial view of the communicator shown in FIG. 4.

FIG. 6 is a perspective pictorial view showing the outer physical appearance of the CT 8. The DP 15 and the KB 14 are arranged on a portable case 41. At the same time, a cord 42 extends outside the case 41. Clips 43 as the line terminals T1 and T2 are connected at the distal end of the cord 42. Therefore, the CT 8 can be detachably connected to lines $l_1$ and $l_2$.

Figure 7:
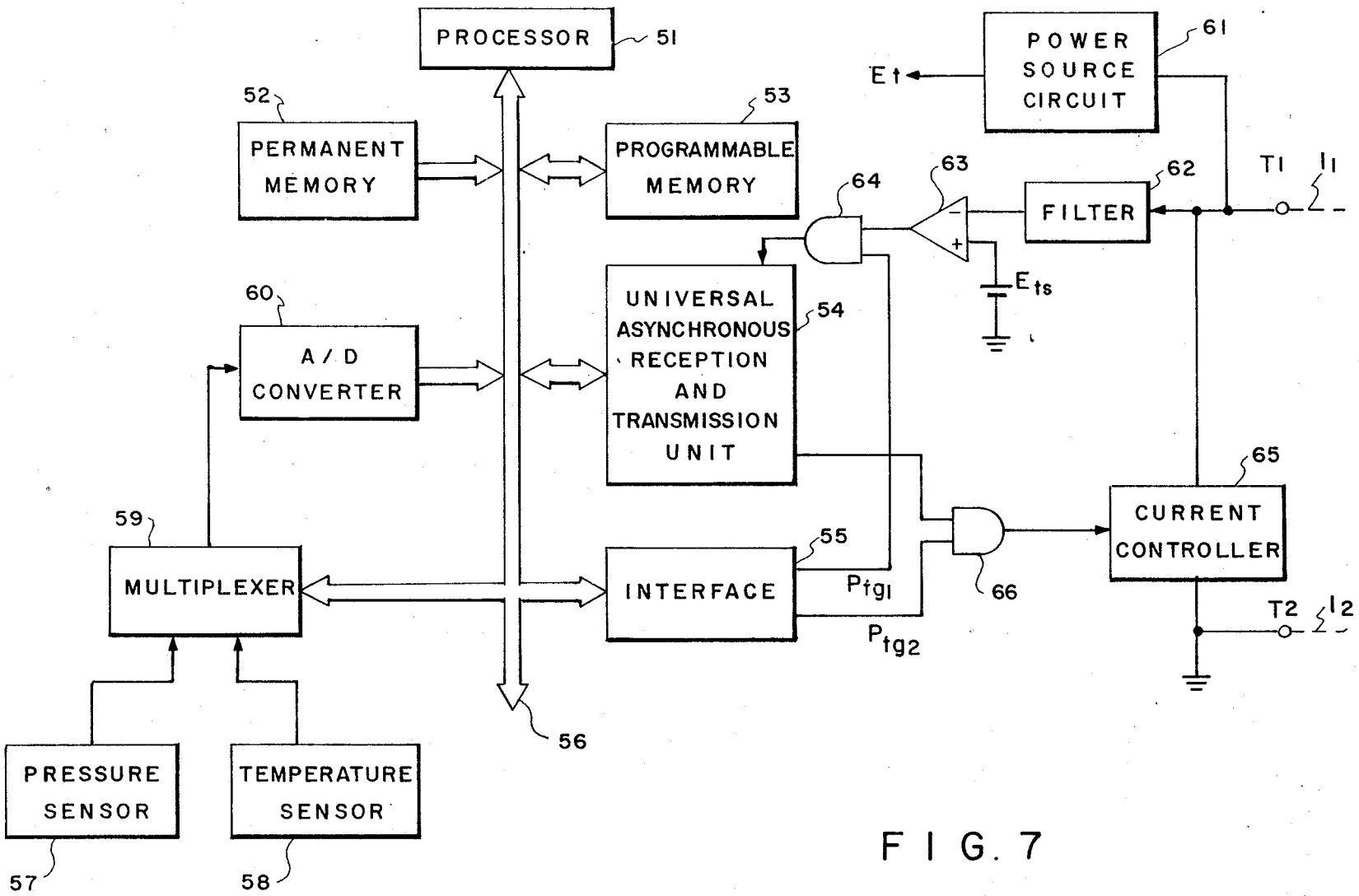
FIG. 7 is a block diagram of a transmitter used in the system shown in FIG. 1, FIGS. 8(A) and 8(B) are flow charts for explaining the control sequences.

FIG. 7 is a block diagram of the TX 3. In the same manner as in FIG. 4, a CPU 51 is connected to a ROM 52, a RAM 53, a UART 54, and an I/F 55 through a bus 56. The CPU 51 performs the control operation in the same manner as in FIG. 4. In addition, the TX 3 further includes a multiplexer (referred to as an MPX hereinafter) 59 for selecting a pressure sensor (referred to as a PSS hereinafter) 57 for detecting a pressure difference or the like, or a temperature sensor (referred to as a TSS) 58 for detecting a temperature of the PSS 57, and an analog-to-digital converter (referred to as an ADC hereinafter) 60 for converting an output from the MPX 59 into a digital signal.

A direct current power source circuit (referred to as a PSC hereinafter) 61 is connected to the terminal T1. In this case, a current of four mA from the line $l_1$ is received and stabilized as a local power source Et. The source Et is supplied to the respective components by lines which have been omitted for the sake of clarity. The voltage between the lines $l_1$ and $l_2$ is filtered through an FL 62 such as a band-pass filter for filtering only the AC component of the digital signal therethrough. The filtered output is supplied to a CP 63 in the same manner as in FIG. 4. The filtered output is compared with a reference voltage Ets and the CP 63 generates a reception output. The reception output is supplied to the UART 55 through an AND gate 64.

If the "H" gate pulse Ptg1 is sent in the reception mode after the measured value word WPV is completely sent, the AND gate 64 is turned ON. During the ON state of the AND gate 64, the command signal REQ is sent. In response to the command signal REQ, the reception output from the CP 63 is sent to the UART 54 to receive the command signal REQ. Thereafter, the CC 65 is turned off, and repetitive transmission of the measured value word WPV is interrupted.

Upon reception of the command signal REQ and the lapse of the predetermined period t3, the CPU 51 sends the "H" gate pulse Ptg2 through the I/F 55 and at the same time controls the UART 54. The transmission pulse is sent to the CC 65 through the AND gate 66. The current corresponding to the word WRE is supplied through the CC 65. When transmission of the words WPV and WRE representing the measured value and the response signal as described with reference to FIG. 3 is completed, the CPU 51 repeats sending out the transmission pulse in response to the measured value word WPV, thereby repetitively sending the measured value. The arrangement of the CC 65 is the same as that in FIG. 5. The TX 3 comprises a nonvolatile memory such as an EAROM. Necessary data is stored in the nonvolatile memory whereby even if a power failure occurs, the data can be retained in the nonvolatile memory.

The CPU 51 controls the MPX 59 to alternately fetch the outputs from the PSS 57 and the TSS 58 at every predetermined interval. The fetched data is stored in the RAM 53. The CPU 51 then performs conversion operations of the detection output from the PSS 57 and encodes the measured value. The coded measured value is sent to the UART 54 so that the measured value word WPV is sent. However, depending on the contents of the command signal REQ, the detection output from the TSS 58 is sent out in the same manner as described above, or the outputs from the PSS 57 and the TSS 58 are sent alternately or in a combination thereof.

Figure 2:
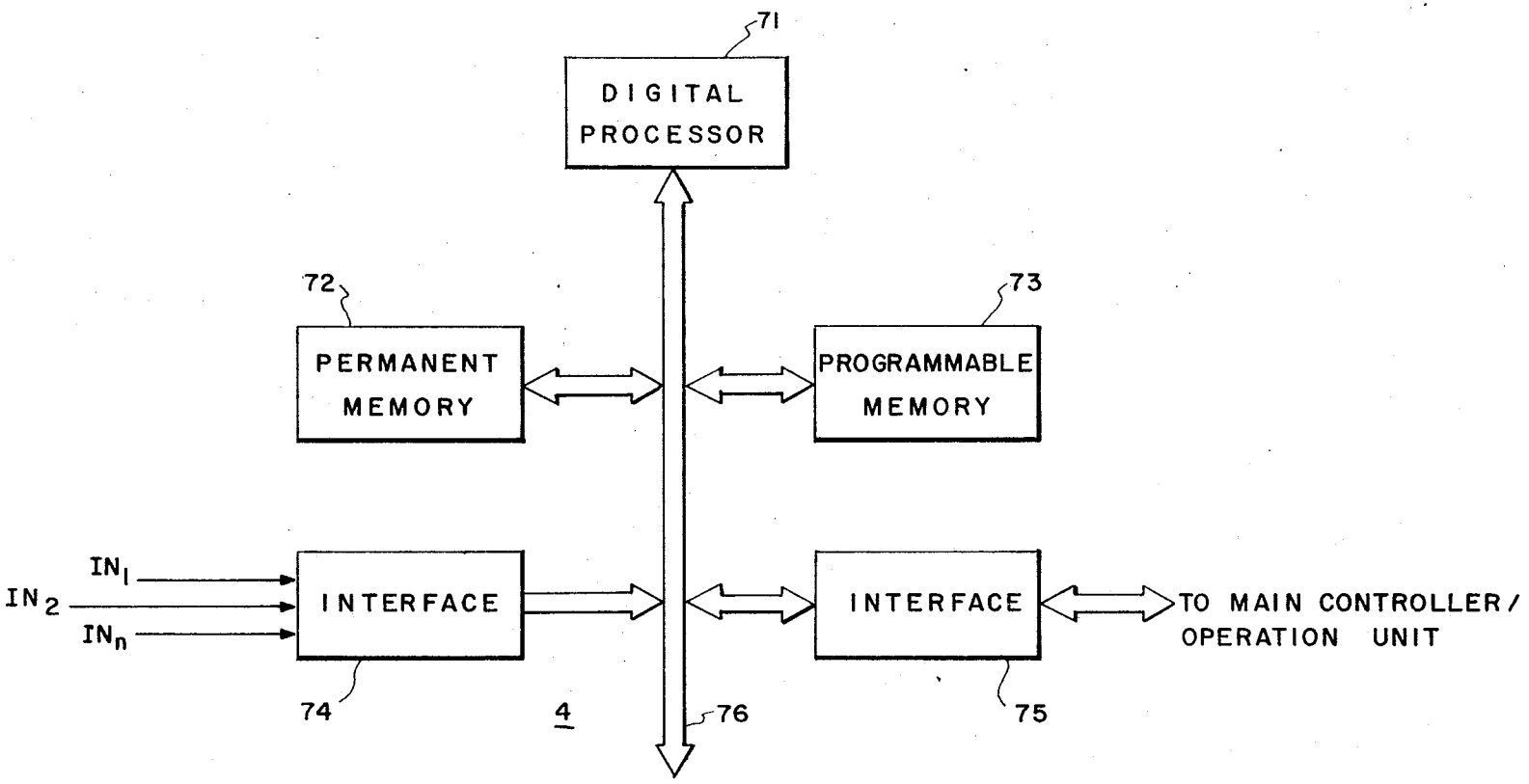
FIG. 2 is a block diagram of a receiver suitable for use in the system shown in FIG. 1 according to a first embodiment of the present invention.

FIG. 2 is a block diagram of the RX 4. The RX 4 comprises a CPU 71 similar to the CPU 11 of FIG. 4, a ROM 72, a RAM 73, and I/Fs 74 and 75. These components are connected to each other through a bus 76. The CPU 71 performs the same operation as that of the CPU 11 so as to achieve reception operation. Inputs IN1 to INn from a plurality of transmission lines are supplied to the I/F 74. Digital signals based on changes in currents of the inputs IN1 to INn are sequentially received, and the CPU 71 performs predetermined processing. The processed results are sent out to the MC 6 through the I/F 75. The CPU 71 stores various types of data in the RAM 73 according to instruction contents and performs processing in response to an instruction supplied from the MC 6 or the OP 7 through the I/F 75/ Therefore, the CPU 71 performs processing of digital signals.

Figure 8A:
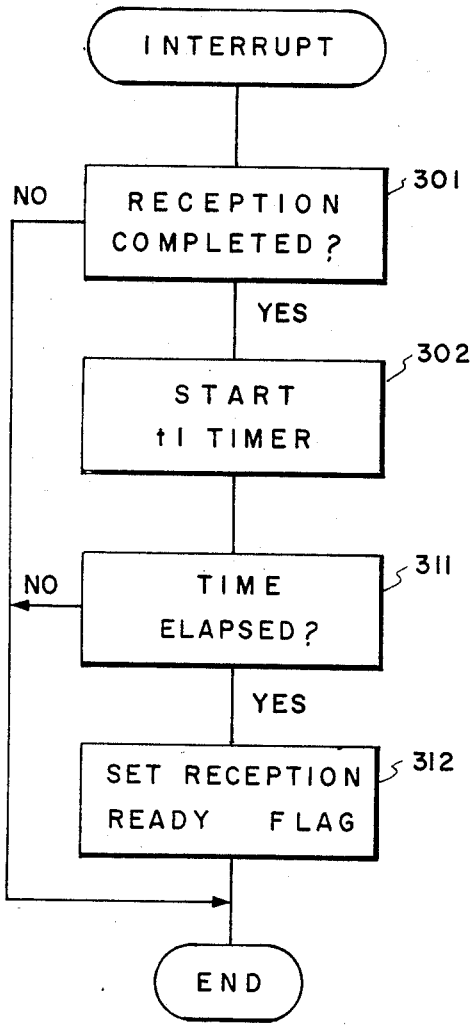
Figure 8B:
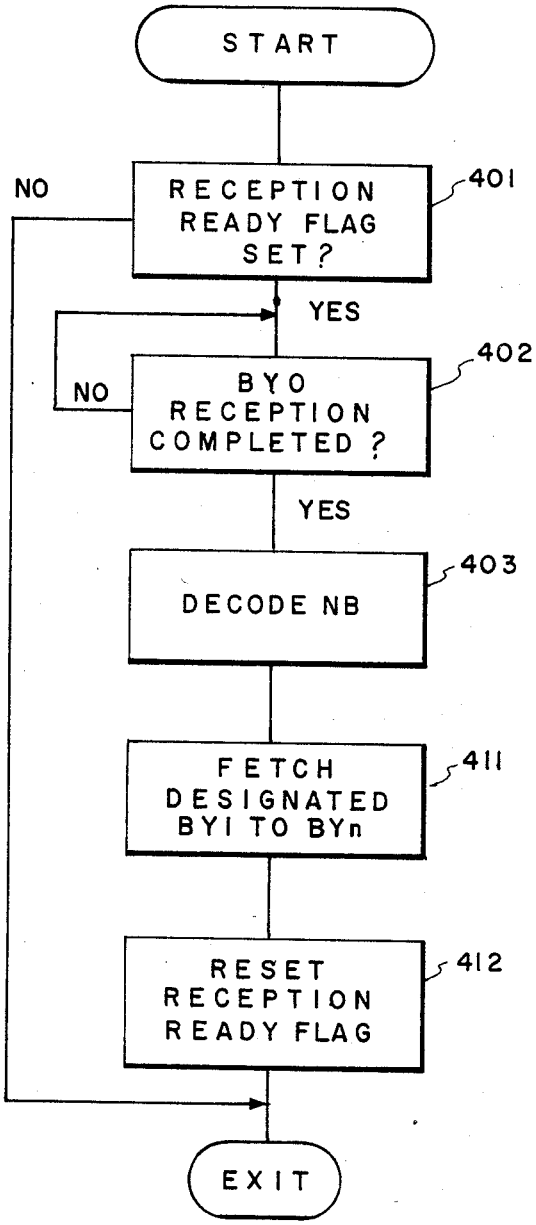

FIGS. 8(A) and 8(B) are flow charts of the control operations of the CPU 71. More specifically, FIG. 8(A) shows interrupt processing, and FIG. 8(B) shows normal processing.Referring to FIG. 8(A), interrupt processing is repeated for a predetermined period shorter than the predetermined period t1 and FIG. 3. The CPU 71 determines in step 301 whether the reception of the signal is completed. If YES in step 301, the "t1" timer incorporated in the CPU 71 is started in step 302. The CPU 71 determines in step 311 whether the timer time has elapsed. If YES in step 311, a reception ready flag is set in memory in step 312.

Referring to FIG. 8(B), the CPU determines in step 401 whether the reception ready flag is set so as to correspond to step 312. If YES in step 401, the reception signal is received from the I/F 74. The CPU 71 then determines in step 402 whether BY0 reception (FIG. 3) is completed. If YES in step 402, the respective bits are read out from the RAM 73. The CPU 71 then decodes NB (i.e, the number of bytes represented by the bit B2 as a specific bit). The CPU 71 then fetches specific bytes BY1 to BYn in step 411. The byte BY1 and the subsequent bytes are sequentially stored in the RAM 73 for a designated predetermined period. The stored data is regarded as valid data. Other data is not fetched and is regarded as invalid data. In correspondence with step 312, the CPU 71 sets the reception ready flag in step 412. The reception signal is no longer received, and the program flow advances to "Exit". The operations in step 401 and the subsequent steps are repeated through other routines.

The lapse of the disable period "t1" of FIG. 3 or the nonsignalling state for the predetermined period t3 is detected in steps 302 and 311. The program flow then advances to steps 403 and 411 so that bytes BY0 to BYn are regarded to be valid for the specific period. However, other bytes are regarded as invalid bytes. Only the measured value word WPV is accurately discriminated and received. The measured value word WPV is transferred to the MC 6 and is used for control operation, thereby preventing the reception control state from disturbance.

The transmission status of the command signal is defined by inequality "t1<t2". The CPU 71 does not affirm step 311. In response to this decision, step 401 is determined to be NO. In this case, the independent measured value word WPV cannot be obtained and is naturally regarded as an invalid word. This control is not associated with the RX 4. However, if the number of bytes of the measured value word WPV is given in advance, step 403 may be omitted. The specific period given as an integer multiple of the byte period t1 may be used, and a predetermined number of bytes may be fetched in step 411. Without adding an address code or the like for designating a destination to each word and signal, a measured value can be transmitted from the TX 3 to the RX 4. The control state in the RX 4 is not disturbed. In the RX 4, a simple means such as a timer is used to selectively receive the measured value word WPV.

Figure 9A:
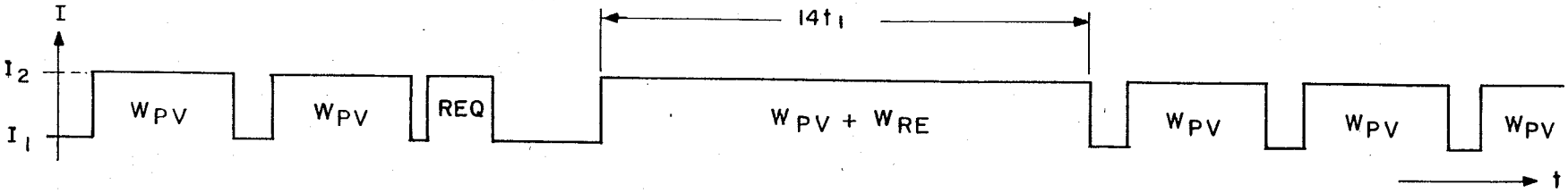
FIGS. 9(A) and 9(B) are timing charts for explaining the control sequence according to a second embodiment of the present invention.
Figure 9B:
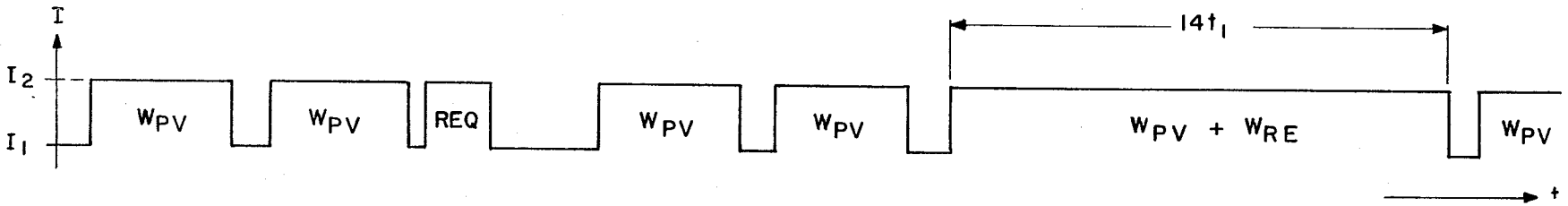

FIGS. 9(A) and 9(B) are timing charts showing another embodiment of the present invention. FIG. 9(A) shows a case wherein a measured value word WPV and a response word WRE are sent together as 14-byte data within a time period "14t1". FIG. 9(B) shows a case wherein the measured value word WPV based on the newest measured value is transmitted twice after reception of the command signal REQ, and then the measured value word WPV and the response signal word WRE are sent as 14-byte data in the same manner as in FIG. 9(A).

If the measured value word TPV based on the newest measured value is always sent to the RX 4, it is suitable to allow the RX 4 to perform best control. However, for allowable variations in measured values, the immediately preceding value may be repeatedly sent. If a variation exceeding the allowable range occurs, the newest measured value may be sent.

In the RX 4, a simple time defining means such as a timer is used to accurately receive only the measured value word. Without adding an address code or the like for designating a destination to each word and signal, a measured value can be transmitted from the TX 3 to the RX 4. The control state in the RX 4 is stabilized. The period "t1" may be equal to the period "t3" according to given conditions. The setting time in step 302 is determined according to the given conditions.

The control means need not be constituted by the CPU 51 but may be by a specific control circuit as a combination of various types of logic circuits. Referring to FIG. 3, a parity check bit may be added for each byte, or an identification code of the TX 3 may be added. Control operations may also be performed in the RX 4.

According to the present invention as is apparent from the above description, there has been provided, a receiver for an accurate reception of only the measured value. Since signals other than the measured value are not accepted, a disturbance of the control operation does not occur, and the control state in the receiver can be stabilized.

The embodiments of the present invention in which an exclusive property or privilege is claimed are defined as follows:

1. A receiver for receiving a digital reception signal defining a measured value, the receiver being connected to a transmission line used for transmitting a digital command signal from a communicator, the digital reception signal from a transmitter, and a response signal responding to the command signal comprising time defining means connected to the transmission line and discriminating that a nonsignalling state of said transmission line has continued for a predetermined period by producing an output signal indicative thereof, and control means connected to receive said output signal and validating a specific period of the reception signal received after the discrimination operation of said time defining means.

2. A receiver according to claim 1 wherein the reception signal is a digital signal obtained by a change in current supplied through said transmission line.

3. A receiver according to claim 1 wherein said time defining means comprises a timer.

4. A receiver according to claim 1 wherein said control means comprises a digital processor.

5. A receiver according to claim 1 wherein the reception signal is a digital signal having a plurality of bytes and the predetermined period is an integer multiple of the number of bytes.

6. A receiver for receiving a digital reception signal defining a measured value, said receiver being connected to a transmission line used for transmitting a digital command signal from a communicator, the digital reception signal from a transmitter, and a response signal responding to the command signal comprising time defining means connected to the transmission line and discriminating that a nonsignalling state of said transmission line has continued for a predetermined period by producing an output signal indicative thereof, and control means connected to receive said output signal and validating the reception signal received after the discrimination operation by said time defining means for a period represented by a specific digital bit of the reception signal.

7. A receiver according to claim 6 wherein the reception signal is a digital signal obtained by a change in current supplied through said transmission line.

8. A receiver according to claim 6 wherein said time defining means comprises a timer.

9. A receiver according to claim 6 wherein said control means comprises a digital processor.

10. A receiver according to claim 6 wherein the reception signal has a plurality of bytes and the predetermined period is an integer multiple of the number of bytes.

11. A receiver for receiving a digital reception signal defining a measured value, said receiver being connected to a two-wire transmission line used for transmitting a digital command signal from a communicator, the digital reception signal from a transmitter, and a response signal responding to the command signal comprising time defining means connected to the transmission line and discriminating that a nonsignalling state of said two-wire transmission line has continued for a predetermined period by producing an output signal indicative thereof, and control means connected to receive said output signal and validating the reception signal received after the discrimination operation by said time defining means for only a given period of time.

12. A receiver according to claim 11 wherein the reception signal is a digital signal obtained by a change in current supplied through said two-wire transmission line.

13. A receiver according to claim 11 wherein said time defining means comprises a timer.

14. A receiver according to claim 11 wherein said control means comprises a digital processor.

15. A receiver according to claim 11 wherein the reception signal is a digital signal having a plurality of bytes and the predetermined period is an integer multiple of the number of bytes.

* * * * *